US008805224B2

(12) United States Patent
Imamiya

(10) Patent No.: US 8,805,224 B2
(45) Date of Patent: Aug. 12, 2014

(54) IMAGE FORMING APPARATUS

(75) Inventor: Koji Imamiya, Kanagawa-ken (JP)

(73) Assignee: Toshiba Tec Kabushiki Kaisha, Tokyo (JP)

( * ) Notice: Subject to any disclaimer, the term of this patent is extended or adjusted under 35 U.S.C. 154(b) by 316 days.

(21) Appl. No.: 13/094,177

(22) Filed: Apr. 26, 2011

(65) Prior Publication Data

US 2011/0262166 A1 Oct. 27, 2011

Related U.S. Application Data

(60) Provisional application No. 61/328,382, filed on Apr. 27, 2010.

(51) Int. Cl.
*G03G 15/20* (2006.01)
*G03G 9/093* (2006.01)

(52) U.S. Cl.
CPC .... *G03G 15/2064* (2013.01); *G03G 2215/2074* (2013.01); *G03G 9/093* (2013.01); *G03G 9/09392* (2013.01)
USPC ..... 399/68; 430/110.2

(58) Field of Classification Search
CPC ..... G03G 15/2064; G03G 2215/2074; G03G 9/093; G03G 9/09392; G03G 15/20; G03G 15/2014; G03G 15/6573; G03G 2215/00413; G03G 2215/207; G03F 7/0022
USPC ..... 399/400, 38, 67–69, 320, 321, 322, 399/328–331; 430/110.1, 110.2, 138
See application file for complete search history.

(56) References Cited

U.S. PATENT DOCUMENTS

| | | | | |
|---|---|---|---|---|
| 5,394,231 | A * | 2/1995 | Sudo et al. | 399/228 |
| 5,428,435 | A * | 6/1995 | Yasuda et al. | 430/123.55 |
| 5,922,115 | A * | 7/1999 | Sano et al. | 106/31.32 |
| 6,203,603 | B1 * | 3/2001 | Takayama et al. | 106/31.16 |
| 6,212,356 | B1 * | 4/2001 | Ishikawa et al. | 399/329 |
| 6,313,066 | B1 | 11/2001 | Takayama | |
| 2010/0209839 | A1 | 8/2010 | Kabai et al. | |

FOREIGN PATENT DOCUMENTS

| | | |
|---|---|---|
| JP | 07-049634 | 2/1995 |
| JP | 2000-284520 | 10/2000 |
| JP | 2000-314984 | 11/2000 |
| JP | 2004-160928 | 6/2004 |
| JP | 2005-059335 | 3/2005 |
| JP | 2006-017810 | 1/2006 |

OTHER PUBLICATIONS

Notification of Reasons for Refusal for Patent Application No. 2011-099249 Dated Apr. 23, 2013, 3 pgs.
Chinese Office Action for Chinese Patent Application No. 201110105594.X mailed on May 13, 2013.

* cited by examiner

*Primary Examiner* — Benjamin Schmitt
(74) *Attorney, Agent, or Firm* — Amin, Turocy & Watson, LLP

(57) ABSTRACT

An image forming apparatus including: a heating member which heats a toner image on a recording medium using a decolorizable toner containing a coloring agent containing a color developable compound and a color developing agent and having a capsule structure covered with an outer shell; a pressing member which is in press contact with the heating member to form a nip portion and nips and conveys the recording medium in cooperation with the heating member; a temperature control section which controls the temperature of the heating member to a temperature not higher than the density maintaining threshold temperature and not lower than the melting threshold temperature; and a conveyance control section which controls the conveying speed of the recording medium such that a time required for the recording medium to pass through the nip portion is 100 msec or more.

8 Claims, 13 Drawing Sheets

FIG. 7

| | | Experimental example 1 | |
|---|---|---|---|
| | Nip width (mm) | 4.5 | |
| | Load (N) | 120 | |
| | | Nip passing time (s) | Melting threshold H/R temperature (°C) |
| Conveying speed (mm/sec) | 15 | 0.300 | 78.5 |
| | 30 | 0.150 | 87.5 |
| | 75 | 0.060 | 97.5 |
| | 100 | 0.045 | 102.5 |
| Conveying speed (mm/sec) | | Nip passing time (s) | Density maintaining threshold H/R temperature (°C) |
| | 15 | 0.300 | 87.5 |
| | 30 | 0.150 | 87.5 |
| | 75 | 0.060 | 93 |
| | 100 | 0.045 | 98 |

FIG. 9

| | | Experimental example 2 | |
|---|---|---|---|
| | Nip width (mm) | 8.75 | |
| | Load (N) | 350 | |
| | | Nip passing time (s) | Melting threshold belt temperature (°C) |
| Conveying speed (mm/sec) | | | |
| | 30 | 0.292 | 77.5 |
| | 75 | 0.117 | 87.5 |
| | 100 | 0.088 | 92.5 |
| Conveying speed (mm/sec) | | Nip passing time (s) | Density maintaining threshold belt temperature (°C) |
| | | | |
| | 30 | 0.292 | 87.5 |
| | 75 | 0.117 | 92.5 |
| | 100 | 0.088 | 92.5 |

FIG. 11

| | | Experimental example 3 | |
|---|---|---|---|
| | Nip width (mm) | 14.5 | |
| | Load (N) | 606 | |
| | | Nip passing time (s) | Melting threshold belt temperature (°C) |
| Conveying speed (mm/sec) | 75 | 0.193 | 83.5 |
| | 100 | 0.145 | 88 |
| | | Nip passing time (s) | Density maintaining threshold belt temperature (°C) |
| | 75 | 0.193 | 89.8 |
| Conveying speed (mm/sec) | 100 | 0.145 | 94 |
| | | | |

RELATIONSHIP BETWEEN NIP PASSING TIME AND MELTING THRESHOLD TEMPERATURE OR DENSITY MAINTAINING THRESHOLD TEMPERATURE

IMAGE FORMING APPARATUS

CROSS-REFERENCE TO RELATED APPLICATION

This application is based upon and claims the benefit of priority from U.S. provisional application 61/328,382, filed on Apr. 27, 2010; the entire contents of which are incorporated herein by reference.

FIELD

Embodiments described herein relate to a technique of an image forming apparatus which forms an image using a decolorizable toner.

BACKGROUND

In an office information environment, due to the widespread use of computer, software, and network, it became possible to accelerate and share information processing. Digitization of information is excellent in terms of storage, accumulation, retrieval, etc. of information, however, a paper medium is superior in terms of display (particularly viewability) and transfer of information. Therefore, as digitization of information is proceeding, the amount of paper used is increasing. On the other hand, reduction of energy consumption typified by $CO_2$ emission is an urgent need in various fields. If a paper medium which is used for temporary display or transfer of information can be recycled, a large contribution can be made to the reduction of energy consumption.

As a technique capable of recycling a paper medium by erasing an image from the paper medium having the image formed thereon, a decolorizable toner is known. With the use of such a decolorizable toner, by heating the toner to a given temperature, a color developable compound and a color developing agent in the ink are dissociated from each other to decolorize the toner, whereby an image is erased.

As the decolorizable toner, a toner produced by a pulverization method is known, however, a plurality of components such as a color developable compound and a color developing agent are handled in a solid phase, and therefore color developing and erasing reactions are neither prompt nor sufficient in some cases. Accordingly, as a toner capable of developing and erasing a color more promptly, a decolorizable toner in which a color developable compound and a color developing agent are encapsulated is proposed.

DESCRIPTION OF THE DRAWINGS

FIG. 7 is a table showing a relationship between a passing time in an image forming apparatus and a density maintaining threshold temperature or a melting threshold temperature.

FIG. 9 is a table showing a relationship between a passing time in an image forming apparatus and a density maintaining threshold temperature or a melting threshold temperature.

FIG. 11 is a table showing a relationship between a passing time in an image forming apparatus and a density maintaining threshold temperature or a melting threshold temperature.

DETAILED DESCRIPTION

An image forming apparatus according to an embodiment is provided with a heating member, a pressing member, a temperature control section, and a conveyance control section.

The heating member heats a toner image formed on a recording medium using a decolorizable toner containing a binder resin and a coloring agent which contains a color developable compound and a color developing agent and which has a capsule structure covered with an outer shell. The pressing member is in press contact with the heating member to form a nip portion and nips and conveys the recording medium in cooperation with the heating member. The temperature control section controls the temperature of the heating member to a temperature not higher than the density maintaining threshold temperature of the toner and not lower than the melting threshold temperature of the toner. The conveyance control section controls the conveying speed of the recording medium in the nip portion such that a time required for the recording medium to pass through the nip portion is 100 msec (millisecond or msecond) or more.

Summary of Image Forming Apparatus

Figure 1:
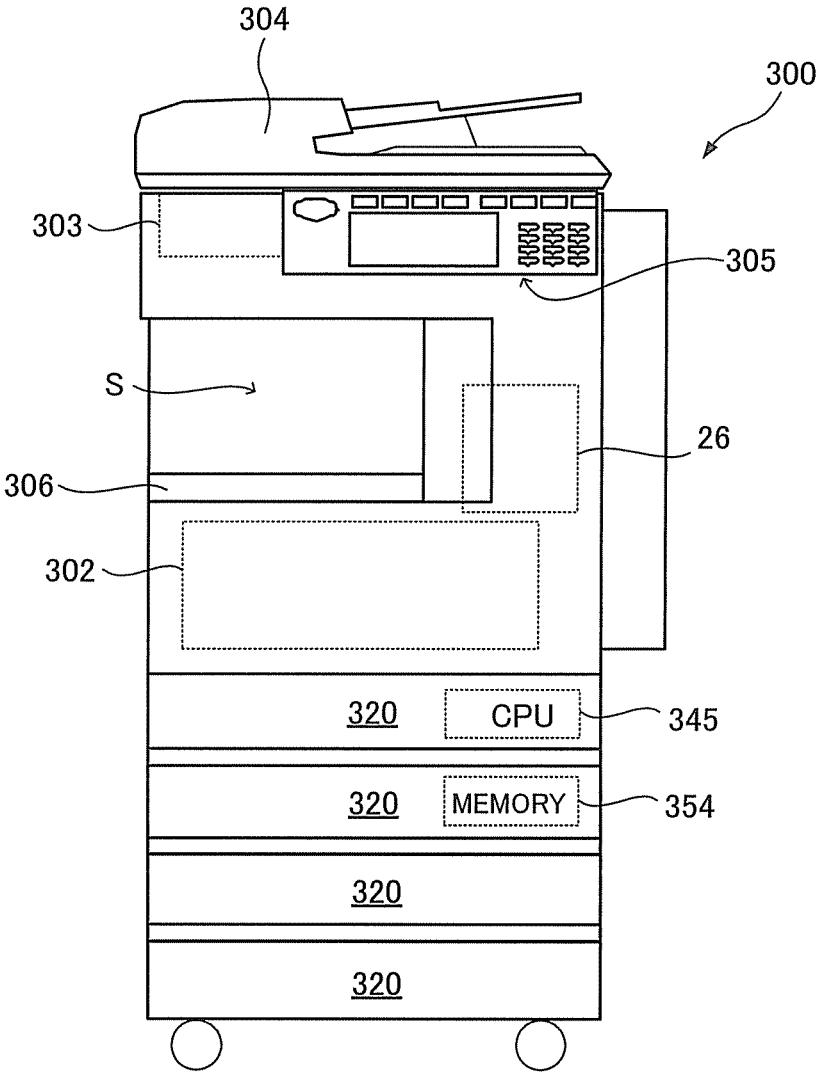
FIG. 1 is a view schematically showing an image forming apparatus according to an embodiment.

First, a structure of an MFP (multifunction peripheral) which is one example of the image forming apparatus according to this embodiment will be described with reference to FIG. 1. FIG. 1 is an external view schematically showing an image forming apparatus.

An image forming apparatus 300 is provided with a paper feed cassette 320 in which a plurality of sheets of paper are contained. The image forming apparatus 300 may be provided with one paper feed cassette and also can be provided with two or more paper feed cassettes. A pickup roller separates the plurality of sheets of paper contained in the paper feed cassette 320 one by one and supplies the paper to a paper conveying path. Then, the paper passes through the paper conveying path and is supplied to a transfer section 302.

A CPU 345 performs various kinds of processing in the image forming apparatus 300. The CPU 345 realizes various functions by implementing a program stored in a memory 354.

The memory 354 is composed of, for example, a RAM (random access memory, a volatile storage device) a ROM (read only memory, a non-volatile storage device), an HDD (hard disk drive, a non-volatile storage device), and the like.

Incidentally, the image forming apparatus 300 may have an ASIC (application specific integrated circuit). Further, it is needless to say that the CPU 345 can be replaced by an MPU (microprocessing unit) which can implement an equivalent arithmetic processing. Besides, similarly, the HDD or the like constituting the memory 354 can be replaced by a storage device such as a flash memory.

The transfer section 302 forms a toner image on paper based on image data. The image data includes, for example, image data transmitted to the image forming apparatus 300 from an external apparatus (such as a personal computer) and image data generated by a reading operation of an image reading device 303.

The image reading device 303 scans an image of a sheet-type original document or a book-type original document, thereby generating image data. In FIG. 1, a part of the image reading device 303 is shown. Above the image reading device 303, a device (ADF: autodocument feeder) 304 for automatically feeding an original document to the image reading device 303 is placed.

On the upper part of the image forming apparatus 300, an operation panel 305 for inputting various kinds of information to the image forming apparatus 300 is provided. The operation panel 305 can be composed of, for example, button switches and a liquid crystal panel.

In the transfer section 302, specifically, an electrostatic latent image is formed based on the image data on a photoconductive surface of a photoconductor, and then, a toner image is formed by supplying a toner. The toner image formed on the surface of the photoconductor is transferred to paper. By bringing the paper into contact with the surface of the photoconductor, the toner image can be transferred to the paper. On the other hand, it is also possible to transfer the toner image on the photoconductor to the paper from an intermediate transfer belt after the toner image is transferred to the intermediate transfer belt.

The toner image transferred to the paper is fixed to the paper by heating with a fixing device 26. The paper having the toner image fixed thereto passes through the paper conveying path and is discharged to a paper discharge space S. In the paper discharge space S, a paper discharge tray 306 for stacking paper is placed.

Subsequently, the transfer section 302 and the fixing device 26 provided for the image forming apparatus 300 according to this embodiment will be described. In this description, the fixing device 26 used in Experimental example 1 described below is shown as an example for facilitating understanding, however, the fixing device is not limited thereto, and a different type of fixing device can be used. For example, the image forming apparatus 300 according to this embodiment may be provided with a fixing device used in Experimental example 2 or 3 described below.

Figure 2:
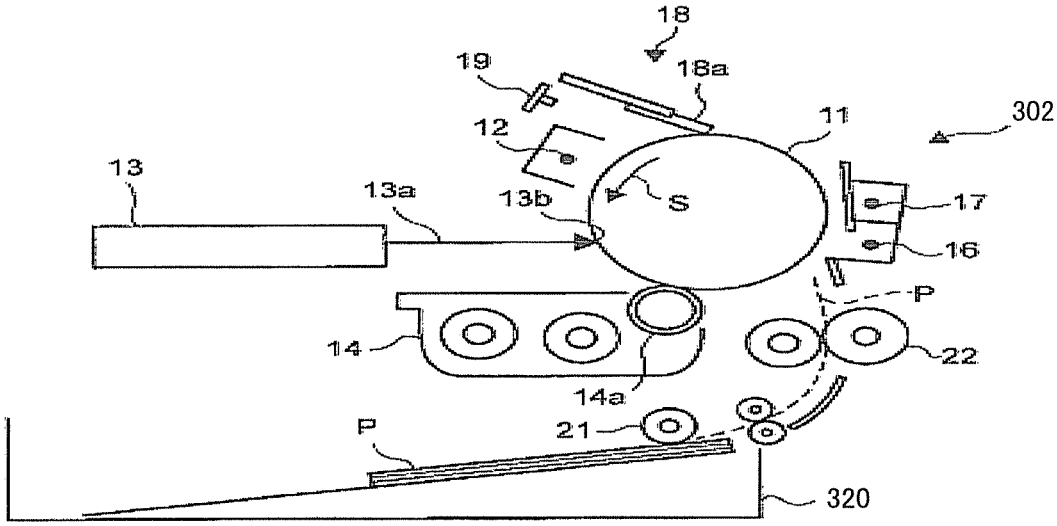
FIG. 2 is a view schematically showing a transfer unit of an image forming apparatus according to an embodiment.

As shown in FIG. 2, a photoconductive drum 11 of the transfer section 302 has an organic photoconductor (OPC) on the surface of a support member having a diameter of 60 mm, and is driven in the direction of the arrow s at a peripheral speed of, for example, 100 mm/sec. Around the photoconductive drum 11, an electric charger 12 which uniformly charges the photoconductive drum 11 to −750 V, an exposure position 13*b* of laser light 13*a* from a laser exposure device 13 which irradiates laser light based on the information of an image onto the charged photoconductive drum 11, a developing device 14, a transfer charger 16, a detachment charger 17, a cleaner 18 having a cleaning blade 18*a*, and a charge elimination LED 19 are arranged in this order in the direction of rotation of the photoconductive drum 11.

At the position of the transfer charger 16 of the transfer section 302, paper P which is a recording medium is taken out from a paper feed cassette 320 by a paper feeding roller 21 and is conveyed in synchronization with a toner image on the photoconductive drum 11 by a resist roller 22. The paper feed cassette 320 can feed unused paper and reuse paper (a recording medium on which a formed image was erased by a decolorizing treatment).

The developing device 14 uses a two-component developer which is a mixture of a toner having a volume average particle diameter of from 5 to 12 μm and a magnetic carrier having a volume average particle diameter of from 30 to 80 μm. The toner according to this embodiment is a decolorizable toner and contains a binder resin and a coloring agent which contains a color developable compound and a color developing agent and which has a capsule structure covered with an outer shell. Hereinafter, this toner is also referred to as a capsule-type decolorizable toner.

To a developing roller 14*a* of the developing device 14, a development bias of about −550 V is applied, and a toner image is formed on the electrostatic latent image on the photoconductive drum 11 by reversal development.

Figure 3:
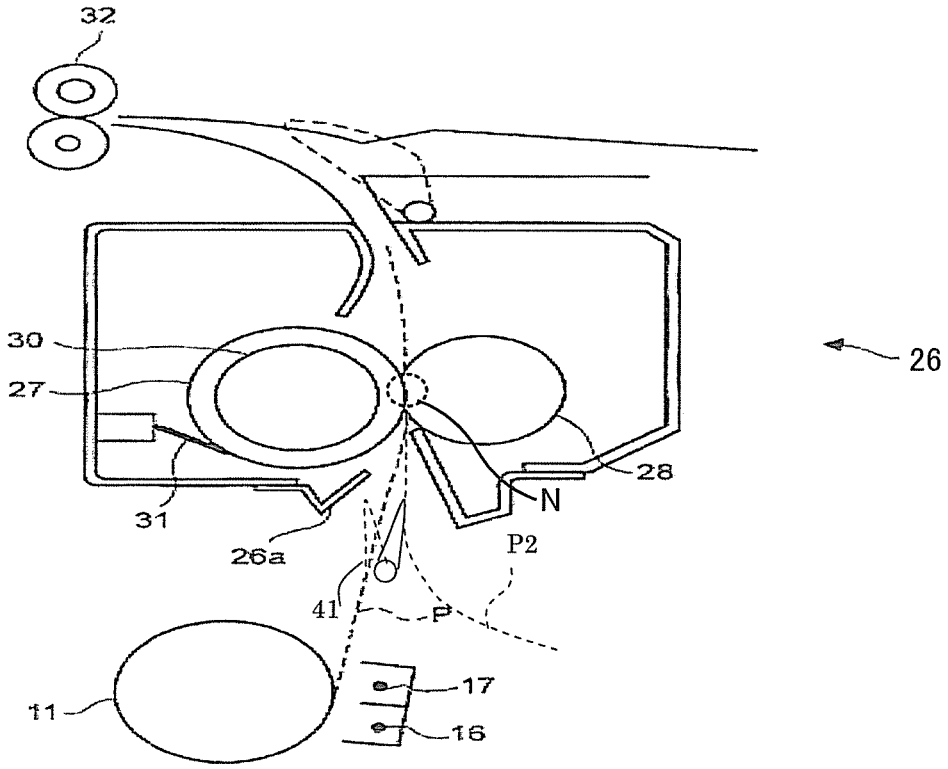
FIG. 3 is a view schematically showing a fixing device of an image forming apparatus according to an embodiment.

On the upper part of the transfer section 302, the fixing device 26 which fixes the toner image by heating and pressing the paper P on which the unfixed toner image is formed using the capsule-type decolorizable toner by the transfer section 302 is provided. As shown in FIG. 3, the fixing device 26 has a fixing roller 27 which is a fixing rotating body, and a pressing roller 28 which is a pressing rotating body and is in press contact with the fixing roller 27. The fixing roller 27 (corresponding to the heating member) heats the toner on the paper P. Further, the pressing roller 28 (corresponding to the pressing member) is in press contact with the fixing roller 27 to form a nip portion N (fixing position) and nips and conveys the paper P in cooperation with the fixing roller 27.

Further, the fixing device 26 has an inlet guide 26*a* for guiding the paper P to the nip portion N between the fixing roller 27 and the pressing roller 28.

The fixing roller 27 can be formed by, for example, coating the surface of an iron hollow cylinder with PTFE (polytetrafluoro ethylene). The fixing roller 27 has an IH coil (induction heating coil) 30 in the inside and is configured to perform induction heating of the fixing roller 27 directly from the inside. The image forming apparatus 300 (more specifically, for example, the CPU 345) controls the current applied to the IH coil 30 such that the temperature of the fixing roller 27 becomes a predetermined temperature according to the output of a thermistor 31 which is in contact with the surface of the fixing roller 27 to detect the temperature thereof.

The pressing roller 28 is prepared by forming an elastic body layer composed of an expanded silicone sponge rubber or the like on a metal shaft and coating the surface thereof with a PFA (a tetrafluoroethylene-perfluoroalkyl vinyl ether copolymer) tube. The hardness of the pressing roller 28 is about 55° measured by ASKER-C. The pressing roller 28 forms the nip portion N with the fixing roller 27 due to the elastic body layer. On the downstream side in the conveying direction of the paper P of the fixing device 26, a paper discharging roller 32 for discharging the paper P in a predetermined direction after fixing is provided.

Subsequently, an image forming process will be described. When an image forming process is started, in the transfer section 302, the photoconductive drum 11 which rotates in the direction of the arrow s is uniformly charged to −750 V by the electric charger 12, laser light is irradiated based on the information of the original document by the laser exposure device 13, whereby an electrostatic latent image is formed. Then, this electrostatic latent image is developed using a capsule-type decolorizable toner by the developing device 14, and a toner image made of the capsule-type decolorizable toner is formed on the photoconductive drum 11.

On the other hand, for example, the predetermined paper P fed from the paper feed cassette 320 is conveyed to the position of the transfer charger 16 by the resist roller 22 in synchronization with the toner image on the photoconductive drum 11, and the toner image on the photoconductive drum 11 is transferred to the paper P.

Then, the paper P is separated from the photoconductive drum 11 and thereafter is passed through the nip portion N formed between the fixing roller 27 and the pressing roller 28 of the fixing device 26. By doing this, the toner image formed on the paper P is fixed thereto by heating and pressing. Since the fixing roller 27 and the pressing roller 28 are in a reversed crown shape, the both ends of the paper P are surely pulled in prior to the center portion when the paper P is inserted in the nip portion between the fixing roller 27 and the pressing roller 28. Due to the reversed crown shape of the pressing roller 28, the paper P is heated, pressed, and fixed while being pulled in the direction from the center to the ends and generation of wrinkles is thus prevented. After completion of the fixation of the toner image formed using the decolorizable toner by the fixing device 26, the paper P is discharged in a predetermined direction by the paper discharging roller 32. After completion of the transfer, the photoconductive drum 11 is cleaned by removing the residual toner by the cleaner 18, the residual charge is removed by the charge elimination LED 19, and the image forming process is completed.

Further, the toner according to this embodiment can be decolorized, and the image formed on the paper P can be erased by a decolorizing treatment.

On the paper P on which the toner image based on the information of the image is formed using the capsule-type decolorizable toner in this manner, the toner image is decolorized for reuse after use (decolorizing treatment). The decolorizing treatment can be performed by, for example, heating the paper P for about 2 hours at 100 to 110° C. in an exclusive decolorizing apparatus manufactured by Toshiba Corporation "e-blue Decolorizing Apparatus: TMD-HE01", thereby decolorizing the toner image. The paper P on which the image was decolorized can be subjected to a new image forming process.

Capsule-Type Decolorizable Toner

Subsequently, the capsule-type decolorizable toner for use in the image forming apparatus 300 according to this embodiment will be described.

The capsule-type decolorizable toner according to this embodiment contains a binder resin and a coloring agent (also referred to as a color material). Incidentally, the coloring agent as used herein refers to one kind of compound or a composition capable of imparting a color to the toner.

The binder resin to be used in the capsule-type decolorizable toner according to this embodiment is not particularly limited, and for example, polyester can be used. The melting point, glass transition temperature Tg, molecular weight, and the like of the binder resin are not particularly limited, and can be suitably determined by a person skilled in the art.

According to this embodiment, the coloring agent contains a color developable compound and a color developing agent.

Specifically, the coloring agent can be composed of an electron donating color developable compound and an electron accepting color developing agent. As the electron donating color developable compound, specifically, a leuco dye can be used. A leuco dye is colorless by itself, but develops a color when the leuco dye is bound to a color developing agent.

Examples of the leuco dye include diphenylmethane phthalides, phenylindolyl phthalides, indolyl phthalides, diphenylmethane azaphthalides, phenylindolyl azaphthalides, fluorans, styrynoquinolines, and diaza-rhodamine lactones.

Specific examples of the leuco dye include 3,3-bis(p-dimethylaminophenyl)-6-dimethylaminophthalide, 3-(4-diethylaminophenyl)-3-(1-ethyl-2-methylindol-3-yl)phthalide, 3,3-bis(1-n-butyl-2-methylindol-3-yl)phthalide, 3,3-bis(2-ethoxy-4-diethylaminophenyl)-4-azaphthalide, 3-(2-ethoxy-4-diethylaminophenyl)-3-(1-ethyl-2-methylindol-3-yl)-4-azaphthalide, 3-[2-ethoxy-4-(N-ethylanilino)phenyl]-3-(1-ethyl-2-methylindol-3-yl)-4-azaphthalide, 3,6-diphenylaminofluoran, 3,6-dimethoxyfluoran, 3,6-di-n-butoxyfluoran, 2-methyl-6-(N-ethyl-N-p-tolylamino)fluoran, 2-N,N-dibenzylamino-6-diethylaminofluoran, 3-chloro-6-cyclohexylaminofluoran, 2-methyl-6-cyclohexylaminofluoran, 2-(2-chloroanilino)-6-di-n-butylaminofluoran, 2-(3-trifluoromethylanilino)-6-diethylaminofluoran, 2-(N-methylanilino)-6-(N-ethyl-N-p-tolylamino)fluoran, 1,3-dimethyl-6-diethylaminofluoran, 2-chloro-3-methyl-6-diethylaminofluoran, 2-anilino-3-methyl-6-diethylaminofluoran, 2-anilino-3-methyl-6-di-n-butylaminofluoran, 2-xylidino-3-methyl-6-diethylaminofluoran, 1,2-benz-6-diethylaminofluoran, 1,2-benz-6-(N-ethyl-N-isobutylamino)fluoran, 1,2-benz-6-(N-ethyl-N-isoamylamino)fluoran, 2-(3-methoxy-4-dodecoxystyryl)quinoline, spiro[5H-(1)benzopyrano(2,3-d)pyrimidine-5,1'(3'H)isobenzofuran]-3'-one, 2-(diethylamino)-8-(diethylamino)-4-methyl-, spiro[5H-(1)benzopyrano(2,3-d)pyrimidine-5,1'(3'H)isobenzofuran]-3'-one, 2-(di-n-butylamino)-8-(di-n-butylamino)-4-methyl-, spiro[5H-(1)benzopyrano(2,3-d)pyrimidine-5,1'(3'H)isobenzofuran]-3'-one, 2-(di-n-butylamino)-8-(diethylamino)-4-methyl-, spiro[5H-(1)benzopyrano(2,3-d)pyrimidine-5,1'(3'H)isobenzofuran]-3'-one, 2-(di-n-butylamino)-8-(N-ethyl-N-i-amylamino)-4-methyl-, spiro[5H-(1)benzopyrano(2,3-d)pyrimidine-5,1'(3'H)isobenzofuran]-3'-one, 2-(di-n-butylamino)-8-(di-n-butylamino)-4-phenyl, 3-(2-methoxy-4-dimethylaminophenyl)-3-(1-butyl-2-methylindol-3-yl)-4,5,6,7-tetrachlorophthalide, 3-(2-ethoxy-4-diethylaminophenyl)-3-(1-ethyl-2-methylindol-3-yl)-4,5,6,7-tetrachlorophthalide, and 3-(2-ethoxy-4-diethylaminophenyl)-3-(1-pentyl-2-methylindol-3-yl)-4,5,6,7-tetrachlorophthalide. Additional examples of the leuco dye include pyridine compounds, quinazoline compounds, and bisquinazoline compounds. These compounds may be used by mixing two or more kinds thereof.

The color developing agent which causes the color developable compound to develop a color is an electron accepting compound which donates a proton to the leuco dye. Examples thereof include phenols, metal salts of phenols, metal salts of carboxylic acids, aromatic carboxylic acids, aliphatic carboxylic acids having 2 to 5 carbon atoms, benzophenones, sulfonic acids, sulfonates, phosphoric acids, metal salts of phosphoric acids, acidic phosphoric acid esters, metal salts of acidic phosphoric acid esters, phosphorous acids, metal salts of phosphorous acids, monophenols, polyphenols, 1,2,3-triazole, and derivatives thereof. Additional examples thereof include those having, as a substituent, an alkyl group, an aryl group, an acyl group, an alkoxycarbonyl group, a carboxy group or an ester thereof, an amide group, a halogen group, or the like, and bisphenols, trisphenols, phenol-aldehyde condensed resins, and metal salts thereof.

Specific examples thereof include phenol, o-cresol, tertiary butyl catechol, nonylphenol, n-octylphenol, n-dodecylphenol, n-stearylphenol, p-chlorophenol, p-bromophenol, o-phenylphenol, n-butyl p-hydroxybenzoate, n-octyl p-hydroxybenzoate, benzyl p-hydroxybenzoate, dihydroxybenzoic acid or esters thereof such as 2,3-dihydroxybenzoate and methyl 3,5-dihydroxybenzoate, resorcin, gallic acid, dodecyl gallate, ethyl gallate, butyl gallate, propyl gallate, 2,2-bis(4-hydroxyphenyl)propane, 4,4-dihydroxydiphenylsulfone, 1,1-bis(4-hydroxyphenyl)ethane, 2,2-bis(4-hydroxy-3-methylphenyl) propane, bis(4-hydroxyphenyl)sulfide, 1-phenyl-1,1-bis(4-hydroxyphenyl)ethane, 1,1-bis(4-hydroxyphenyl)-3-methylbutane, 1,1-bis(4-hydroxyphenyl)-2-methylpropane, 1,1-bis(4-hydroxyphenyl)-n-hexane, 1,1-bis(4-hydroxyphenyl)-n-heptane, 1,1-bis(4-hydroxyphenyl)-n-octane, 1,1-bis (4-hydroxyphenyl)-n-nonane, 1,1-bis(4-hydroxyphenyl)-n-decane, 1,1-bis(4-hydroxyphenyl)-n-dodecane, 2,2-bis(4-hydroxyphenyl)butane, 2,2-bis(4-hydroxyphenyl)ethyl propionate, 2,2-bis(4-hydroxyphenyl)-4-methylpentane, 2,2-bis(4-hydroxyphenyl)hexafluoropropane, 2,2-bis(4-hydroxyphenyl)-n-heptane 2,2-bis(4-hydroxyphenyl)-n-nonane, 2,4-dihydroxyacetophenone, 2,5-dihydroxyacetophenone, 2,6-dihydroxyacetophenone, 3,5-dihydroxyacetophenone, 2,3,4-trihydroxyacetophenone, 2,4-dihydroxybenzophenone, 4,4'-dihydroxybenzophenone, 2,3,4-trihydroxybenzophenone, 2,4,4'-trihydroxybenzophenone, 2,2',4,4'-tetrahydroxybenzophenone, 2,3,4,4'-tetrahydroxybenzophenone, 2,4'-biphenol, 4,4'-biphenol, 4-[(4-hydroxyphenyl)methyl]-1,2,3-benzenetriol, 4-[(3,5-dimethyl-4-hydroxyphenyl)methyl]-1,2,3-benzenetriol, 4,6-bis[(3,5-dimethyl-4-hydroxyphenyl)methyl]-1,2,3-benzenetriol, 4,4'-[1,4-phenylenebis(1-methylethylidene)bis (benzene-1,2,3-triol)], 4,4'-[1,4-phenylenebis(1-methylethylidene)bis(1,2-benzenediol)], 4,4',4"-ethylidenetrisphenol, 4,4'-(1-methylethylidene)bisphenol, and methylenetris-p-cresol. These compounds may be used by mixing two or more kinds thereof.

The coloring agent develops a color when the color developable compound such as a leuco dye and the color developing agent which is a phenolic compound are associated with each other, and erases the color when the color developable compound and the color developing agent are dissociated from each other or the color developable compound is decomposed.

In this embodiment, the coloring agent is encapsulated, and has an outer shell composed of a shell material (encapsulating agent). As the shell material, a urethane resin or the like is used. By encapsulating the coloring agent, the redevelopment of the erased color due to the effect of particularly the acid value of the binder resin in the toner can be prevented.

Further, in the encapsulated coloring agent, the leuco dye and the color developing agent may be allowed to exist in a resin (temperature control agent) which has a large temperature difference between the melting point and the solidifying point. In this case, when the encapsulated coloring agent is heated to the melting point of the temperature control agent, the bond between the leuco dye and the color developing agent is cleaved and the color is erased. Thereafter, even if the encapsulated coloring agent is cooled, since the solidifying point of the temperature control agent is normal temperature or lower, the encapsulated coloring agent is maintained in a decolorized state.

Further, the toner according to this embodiment may contain therein or hold on the outer surface thereof another component as needed. Examples of such another component include a release agent, a charge control agent, an aggregating agent, a neutralizing agent, and an external additive.

The release agent is blended in the binder resin along with the coloring agent. Examples of the release agent include aliphatic hydrocarbon waxes such as low-molecular weight polyethylenes, low-molecular weight polypropylenes, polyolefin copolymers, polyolefin waxes, paraffin waxes, and Fischer-Tropsch waxes and modifications thereof; vegetable waxes such as candelilla wax, carnauba wax, Japan wax, jojoba wax, and rice wax; animal waxes such as bees wax, lanolin, and spermaceti wax; mineral waxes such as montan wax, ozokerite, and ceresin; fatty acid amides such as linoleic acid amide, oleic acid amide, and lauric acid amide; and silicone-based waxes.

In this embodiment, as the release agent, particularly, those having an ester bond of a component composed of an alcohol component and a carboxylic acid component are preferred. Examples of the alcohol component include higher alcohols, and examples of the carboxylic acid component include saturated fatty acids having a linear alkyl group, unsaturated fatty acids such as monoenic acid and polyenic acid, and hydroxy fatty acids. Further, examples of the carboxylic acid component include unsaturated polyvalent carboxylic acids such as maleic acid, fumaric acid, citraconic acid, and itaconic acid. Further, anhydrides thereof may be used.

Among the above-mentioned carboxylic acid components, unsaturated polyvalent carboxylic acid components and anhydrides thereof are particularly preferred.

From the viewpoint of low-temperature fixability, the softening point of the release agent is preferably from 60° C. to 120° C., more preferably from 70° C. to 110° C.

In the capsule-type decolorizable toner according to this embodiment, a charge control agent or the like for controlling a frictional charge amount may be blended. As the charge control agent, a metal-containing azo compound is used, and the metal element is preferably a complex or a complex salt of iron, cobalt, or chromium or a mixture thereof. Further, a metal-containing salicylic acid derivative compound is also used, and the metal element is preferably a complex or a complex salt of zirconium, zinc, chromium, or boron, or a mixture thereof.

In this embodiment, in order to adjust the fluidity or chargeability of toner particles, inorganic fine particles may be externally added and mixed therewith in an amount of from 0.01 to 20% by mass based on the amount of the toner particles. As such inorganic fine particles, silica, titania, alumina, strontium titanate, tin oxide, and the like can be used alone or by mixing two or more kinds thereof. It is preferred that as the inorganic fine particles, those surface-treated with a hydrophobizing agent are used from the viewpoint of improvement of environmental stability. Further, other than such inorganic oxides, resin fine particles having a particle size of 1 μm or less may be externally added for improving the cleaning property.

Still further, in this embodiment, the toner may be encapsulated using a shell material (for example, a resin). As the resin to be used as the shell material, a resin obtained by copolymerizing an aromatic vinyl component and a (meth) acrylic acid ester component is preferred other than the above-mentioned polyester resins. Examples of the aromatic vinyl component include styrene, α-methylstyrene, o-methylstyrene, and p-chlorostyrene. Further, a sulfonic acid-based aromatic vinyl component such as sodium p-styrenesulfonate may be used. Examples of the acrylic acid ester component include ethyl acrylate, propyl acrylate, butyl acrylate, 2-ethylhexyl acrylate, butyl methacrylate, ethyl methacrylate, and methyl methacrylate. Among these, butyl acrylate is generally used. As the polymerization method, an emulsion polymerization method is generally employed, and the resin can be obtained by radical polymerization of monomers of the respective components in an aqueous phase containing an emulsifying agent.

Other than these, a surfactant, a neutralizing agent, an aggregating agent, or the like may be used in the course of the production of the toner.

Examples of the surfactant include anionic surfactants such as sulfate-based, sulfonate-based, phosphate-based, and soap-based anionic surfactants; cationic surfactants such as amine salt-based, and quaternary ammonium salt-based cationic surfactants; and nonionic surfactants such as polyethylene glycol-based, alkyl phenol ethylene oxide adduct-based, and polyhydric alcohol-based nonionic surfactants.

Examples of the aggregating agent include metal salts such as sodium chloride, calcium chloride, calcium nitrate, barium chloride, magnesium chloride, zinc chloride, magnesium sulfate, aluminum chloride, aluminum sulfate, and potassium aluminum sulfate; inorganic metal salt polymers such as polyaluminum chloride, polyaluminum hydroxide, and calcium polysulfide; polymeric aggregating agents such as polymethacrylic acid esters, polyacrylic acid esters, polyacrylamides, and acrylamide-sodium acrylate copolymers; coagulating agents such as polyamines, polydiallyl ammonium halides, melanin formaldehyde condensates, and dicyandiamide; alcohols such as methanol, ethanol, 1-propanol, 2-propanol, 2-methyl-2-propanol, 2-methoxyethanol, 2-ethoxyethanol, and 2-butoxyethanol; organic solvents such as acetonitrile and 1,4-dioxane; inorganic acids such as hydrochloric acid and nitric acid; and organic acids such as formic acid and acetic acid.

As the neutralizing agent, an inorganic base or an amine compound can be used. Examples of the inorganic base include sodium hydroxide and potassium hydroxide. Examples of the amine compound include dimethylamine, trimethylamine, monoethylamine, diethylamine, triethylamine, propylamine, isopropyl amine, dipropylamine, butylamine, isobutylamine, sec-butylamine, monoethanolamine, diethanolamine, triethanolamine, triisopropanolamine, isopropanolamine, dimethylethanolamine, diethylethanolamine, N-butyldiethanolamine, N,N-dimethyl-1,3-diaminopropane, and N,N-diethyl-1,3-diaminopropane.

Incidentally, in the capsule-type decolorizable toner according to this embodiment, the content ratios of the respective components can be suitably determined by a person skilled in the art.

Subsequently, a method for producing the capsule-type decolorizable toner according to this embodiment will be described. The method for producing the toner according to this embodiment is not particularly limited.

For example, the toner can be produced by aggregating and fusing an encapsulated coloring agent and particles of a binder resin.

Examples of a method for forming the encapsulated coloring agent include an interfacial polymerization method, a coacervation method, an in-situ polymerization method, a submerged drying method, and a submerged curing coating method.

Further, a method for preparing the particles containing a binder resin is not particularly limited, and for example, the particles can be prepared using a melt-kneading method or an emulsion polymerization method. The size of the fine particles containing a binder resin is not particularly limited. Specifically, for example, a composition containing a binder resin is processed using a high-pressure homogenizer, whereby a dispersion liquid of particles containing the binder resin is obtained.

A dispersion liquid of a release agent can also be obtained in the same manner as the case of the dispersion liquid of particles containing the binder resin.

Subsequently, the thus prepared encapsulated coloring agent and particles containing the binder resin are aggregated. Specifically, to a dispersion liquid in which the coloring agent and the particles containing the binder resin are dispersed in a dispersion medium, for example, an aqueous dispersion medium such as water, an aggregating agent is added, followed by heating to effect aggregation. The type of the aggregating agent, the addition amount thereof, and the heating temperature can be suitably determined by a person skilled in the art.

Thereafter, the fluidity of the binder resin is increased by heating, whereby the aggregated coloring agent and particles containing the binder resin are fused to one another. The heating temperature in the fusing treatment can also be suitably determined by a person skilled in the art.

Subsequently, particles obtained by the fusing treatment are washed and dried, whereby a capsule-type decolorizable toner is produced. To the thus produced capsule-type decolorizable toner, an external additive such as silica or titanium oxide is externally added as needed.

An apparatus for performing washing in this embodiment is not particularly limited, however, for example, a centrifugal separator, a filter press, or the like is preferably used. In the washing treatment, as a washing liquid, for example, water, ion exchanged water, purified water, water adjusted to an acidic pH, water adjusted to a basic pH, or the like is used, and washing and filtration are repeated, whereby a water-containing cake is obtained. The water-containing cake is dried to a water content of about 1% by mass by a given drying method such as a flash dryer, a vibration dryer, or an oven. The dried material is crushed by a given method.

Temperature Control Section and Conveyance Control Section

Figure 4:
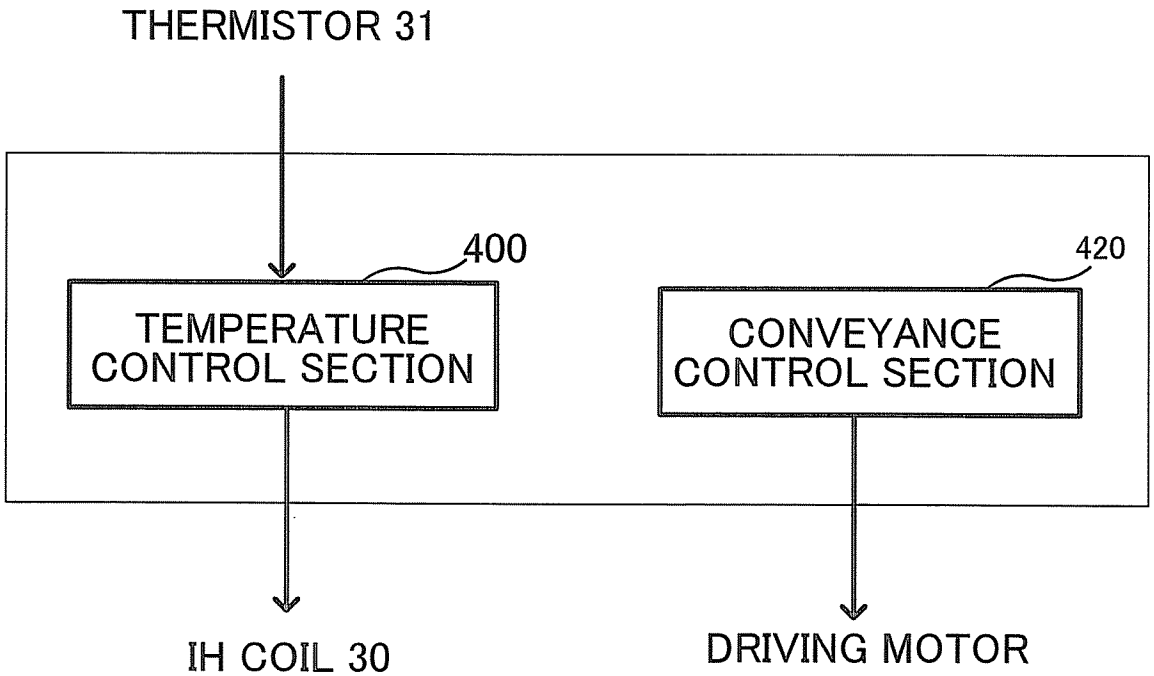
FIG. 4 is a functional block diagram of a fixing treatment in an image forming apparatus according to an embodiment.

Subsequently, functional blocks related to the fixing treatment in the image forming apparatus 300 according to this embodiment will be described. As shown in FIG. 4, the image forming apparatus 300 according to this embodiment is provided with a temperature control section 400 and a conveyance control section 420. Each functional block can be realized by implementing a program read from the memory 354 by the CPU 345.

The temperature control section 400 controls the temperature of the fixing roller 27 based on the information as to the temperature of the fixing roller 27 output from the thermistor 31 in response to the acquisition of a demand for implementing an image forming process by the image forming apparatus 300. Specifically, the temperature control section 400 controls the current applied to the IH coil 30. In this embodiment, the temperature control section 400 controls the temperature of the fixing roller 27 to a temperature not higher than the density maintaining threshold temperature of the toner and not lower than the melting threshold temperature of the toner. In a preferred embodiment, the temperature control section 400 controls the temperature of the fixing roller 27 to 100° C. or lower, more preferably 90° C. or lower.

Incidentally, the density maintaining threshold temperature of the toner as used herein refers to a threshold (highest) temperature of the heating member at which the image density is not decreased by heating in the fixing treatment. The temperature of the heating member is also referred to as a fixing control temperature in this specification. If the fixing control temperature is set to a temperature higher than the density maintaining threshold temperature, the coloring agent is decolorized by the fixing treatment, and therefore, the image density is decreased as compared with the case where the fixing treatment is performed at a temperature not higher than the density maintaining threshold temperature.

Further, the melting threshold temperature of the toner as used herein refers to a threshold (lowest) temperature of the heating member at which the toner on a recording medium can be uniformly melted. If the fixing control temperature is set to a temperature lower than the melting threshold temperature of the toner, the toner on a recording medium is not uniformly melted, and as a result, fixation failure occurs (for example, the toner is detached from the recording medium after the fixing treatment, and so on).

Incidentally, specific examples of the fixing control temperature include the below-mentioned H/R temperature (temperature of the fixing roller 27) and belt temperature (temperature of the fixing belt). Therefore, hereinafter, a temperature corresponding to the density maintaining threshold temperature of the H/R temperature is also referred to as a density maintaining threshold H/R temperature, and a temperature corresponding to the density maintaining threshold temperature of the belt temperature is also referred to as a density maintaining threshold belt temperature. Similarly, a temperature corresponding to the melting threshold temperature of the H/R temperature is also referred to as a melting threshold H/R temperature, and a temperature corresponding to the melting threshold temperature of the belt temperature is also referred to as a melting threshold belt temperature.

The conveyance control section 420 rotates the fixing roller 27 and the pressing roller 28 by controlling a driving motor (not shown) in response to the acquisition of a demand for implementing an image forming process by the image forming apparatus 300. Here, in this embodiment, the conveyance control section 420 controls the conveying speed of paper P in the nip portion N such that a time required for the paper P to pass through the nip portion N is 100 msec or more, more preferably 200 msec or more. If the time required for the paper P to pass through the nip portion N is less than 100 msec, a possibility to cause fixation failure or a decrease in image density is high. Further, although the upper limit thereof is not specifically limited, from the viewpoint of preventing an increase in the size of the apparatus, the time required for the paper P to pass through the nip portion N is preferably 500 msec or less, more preferably 300 msec or less.

Incidentally, the time required for a recording medium to pass through the nip portion (hereinafter also referred to as merely "passing time") as used herein refers to a time between when a portion (for example, a front end in the conveying direction) of a recording medium reaches the nip portion N around the center (in the vicinity of the center in the direction orthogonal to the conveying direction) of the nip portion N and when the recording medium is discharged. In this embodiment, the passing time can be calculated based on the nip width and the conveying speed.

Figure 5:
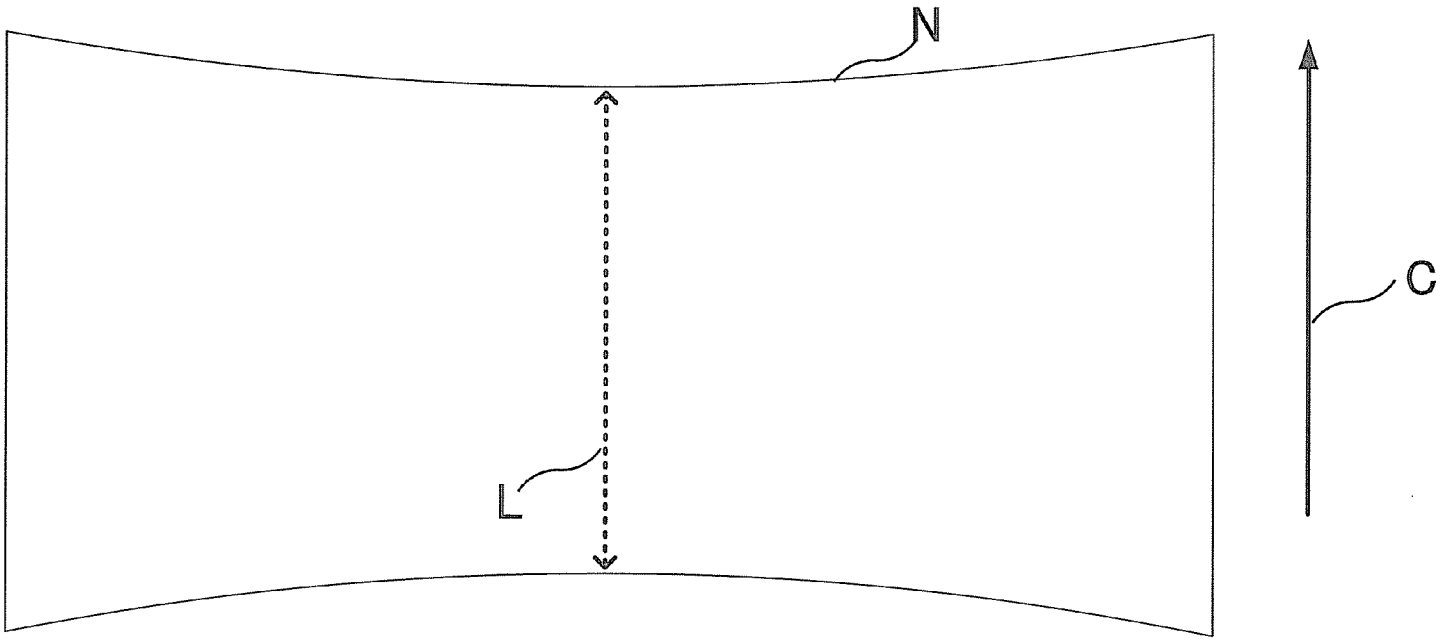
FIG. 5 is a schematic plan view of a nip portion N including the conveying direction.

Further, the nip width as used herein refers to a length in the conveying direction around the center in the nip portion N. For facilitating understanding, a schematic plan view of the nip portion N is shown in FIG. 5 along with the conveying direction. In FIG. 5, C indicates the conveying direction; and L indicates the nip width.

The nip width can be determined as follows. A PET sheet having a thickness of 100 μm is nipped by the nip in a state where the surface temperature of the fixing roller is about 180° C., and the PET sheet is left as such for 30 seconds and thereafter taken out, and the width of a portion turning into cloudy white is measured.

Fixing Treatment Flow in Image Forming Process

Figure 6:
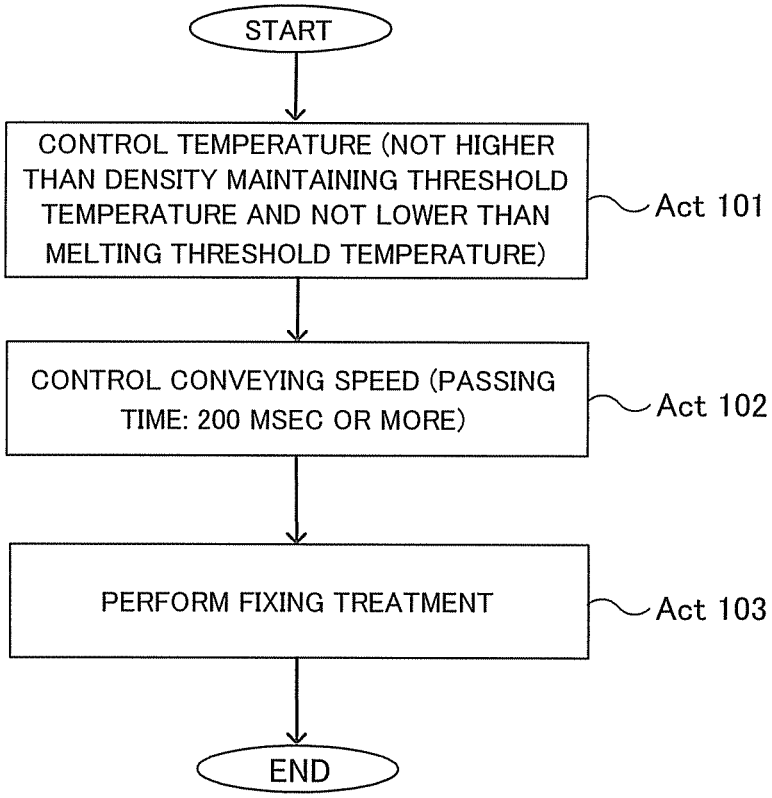
FIG. 6 is a view showing a flow diagram of a fixing treatment in an image forming apparatus according to an embodiment.

One example of a flow of a fixing treatment in the image forming process according to this embodiment is shown in FIG. 6.

In Act 101, the temperature control section 400 controls the temperature of the fixing roller 27 to a temperature not higher than the density maintaining threshold temperature of the toner and not lower than the melting threshold temperature of the toner based on the information as to the temperature of the fixing roller 27 output from the thermistor 31.

In Act 102, the conveyance control section 420 rotates the fixing roller 27 and the pressing roller 28 at a conveying speed such that a time required for the paper P to pass through the nip portion N is 100 msec or more.

In Act 103, a fixing treatment is performed by passing the paper P through the nip portion N of the fixing device 26.

Incidentally, the order of the controlling of the temperature by the temperature control section 400 and the controlling of the conveying speed by the conveyance control section 420 is not limited to that shown in FIG. 6, and either may be performed first.

Setting of Passing Time

The reason why the conveying speed of paper P in the nip portion N is controlled by the conveyance control section 420 such that a time required for the paper P to pass through the nip portion N is 100 msec or more will be described.

The capsule-type decolorizable toner in which the color developable compound and the color developing agent are encapsulated can be promptly decolorized. On the other hand, when the fixing treatment was performed at a conventional fixing control temperature (for example, 180° C.), if the fixing control temperature is higher than a threshold temperature at which the density of an image is maintained, the coloring agent was decolorized, and as a result, the density of the image obtained by using the toner was decreased and the image was not formed on the paper P in some cases.

As a result of intensive studies, the present inventors found that by setting the fixing control temperature to a temperature not higher than the density maintaining threshold temperature of the toner and not lower than the melting threshold temperature of the toner and also by setting the time required for the paper P to pass through the nip portion N to 100 msec or more, a toner image can be fixed to the paper P while preventing the decolorization of the image in the fixing treatment, and thus completed the invention.

In Experimental examples 1 to 3 described below, a nip width was changed within a range of 4.5 mm to 14.5 mm inclusive, and a load was changed within a range of 120 N to 606 N inclusive.

In Experimental examples 1 to 3, as a recording medium, Mondi Paper (90 g/m$^2$) was used.

Further, the image density of a solid image formed in each experiment was measured using a reflection densitometer Macbeth RD-19I.

Further, it was determined whether or not the toner was removed by rubbing a portion of the solid image formed with cotton and observing whether or not the image was removed.

Further, the decolorizing treatment of the solid image formed was performed by heating the recording medium at 100° C. for about 2 hours in an exclusive decolorizing apparatus manufactured by Toshiba Corporation "e-blue Decolorizing Apparatus: TMD-HE01".

Experimental Example 1

In Experimental example 1, an image forming apparatus provided with the fixing device shown in FIG. 3 was used. The description of the structures of the transfer section 302 and the fixing device 26 and the image forming process is omitted for avoiding duplication.

Incidentally, in Experimental example 1, the nip width was 4.5 mm (the length at both ends was 5 mm).

Further, as the toner, a toner produced as follows was used.

Preparation of Finely Pulverized Liquid Containing Binder Resin

As a binder resin, a Pes (polyester) resin having a glass transition temperature Tg of 50° C. and a softening point of 100° C. was used. A dispersion liquid (finely pulverized liquid) containing the binder resin was prepared with a high-pressure homogenizer using 30 parts by mass of the Pes resin, 3 parts by mass of an anionic emulsifying agent (Neopelex G-15 manufactured by Kao Corporation), and 0.6 parts by mass of a neutralizing agent (dimethylaminoethanol).

Preparation of Finely Pulverized Release Agent Liquid

A finely pulverized liquid was prepared using 30 parts by mass of rice wax in the same manner as in the case of the above binder resin.

Preparation of Coloring Agent

Components including 1 part by mass of 3-(2-ethoxy-4-diethylaminophenyl)-3-(1-ethyl-2-methylindol-3-yl)-4-azaphthalide as a leuco dye, 5 parts by mass of 2,2-bis(4-hydroxyphenyl)hexafluoropropane as a color developing agent, and 50 parts by mass of a diester compound of pimelic acid with 2-(4-benzyloxyphenyl)ethanol as a decolorizing agent (temperature control agent) were dissolved by heating. Then, 20 parts by mass of an aromatic polyvalent isocyanate prepolymer and 40 parts by mass of ethyl acetate were mixed therein as encapsulating agents. The resulting solution was poured into 250 parts by mass of an aqueous solution of 8% polyvinyl alcohol, and the resulting mixture was emulsified and dispersed. After stirring was continued at 70° C. for about 1 hour, 2 parts by mass of a water-soluble aliphatic modified amine was added thereto as a reaction agent, and stirring was further continued for about 3 hours while maintaining the temperature of the liquid at 90° C., whereby colorless encapsulated particles were obtained. Further, the resulting encapsulated particle dispersion was placed in a freezer (at −30° C.) to develop a color, whereby a blue coloring agent was obtained. The volume average particle diameter of these colored particles C1 was measured using SALD-7000 manufactured by Shimadzu Corporation and found to be 2 μm.

Aggregation and Fusion Step 10 parts by mass of the encapsulated coloring agent, 283 parts by mass of the finely pulverized liquid containing the binder resin, and 17 parts by mass of the finely pulverized release agent liquid were mixed and fine particles contained in the resulting mixture were aggregated at 45° C. using 100 parts by mass of an aqueous solution of 5% aluminum sulfate [$Al_2(SO_4)_3$]. Then, the temperature was raised to 65° C. (temperature raising speed: 1° C./min) to fuse the aggregated particles, followed by washing and drying, whereby a capsule-type decolorizable toner was obtained. The amount of the coloring agent in the capsule-type decolorizable toner was 10% by mass.

The thus obtained toner had a complete decolorization temperature of 95° C., a decolorization initiation temperature of 85° C., and a complete color development temperature of −5° C.

Incidentally, a decolorizable toner containing a temperature control agent generally exhibits a thermal property as disclosed in FIG. 1 of Japanese Patent No. 3984509.

The complete decolorization temperature of a toner having such a property refers to a temperature when an image density in a completely decolorized state (a state in which the color developable compound and the color developing agent are not bound to each other and the development of a color based on the binding does not occur) is exhibited.

Further, the decolorization initiation temperature of such a toner refers to a temperature when an image density at a temperature at which decolorization is initiated is exhibited, and has the same definition as the density maintaining threshold temperature in this specification.

Further, the complete color development temperature of such a toner refers to a temperature when an image density in a completely color developed state (a state in which the highest image density is exhibited by the toner having a given composition) is exhibited.

In the image forming apparatus in Experimental example 1, a solid image was formed while changing the time for which the recording medium passed through the nip portion N (nip width: 4.5 mm) as shown in FIG. 7 by setting the conveying speed in the fixing device to 100, 75, 30, or 15 mm/sec. Further, the melting threshold temperature (melting threshold H/R temperature) and the density maintaining threshold temperature (density maintaining threshold H/R temperature) at that time are also shown in FIG. 7.

Experimental Example 2

In Experimental example 2, an image forming apparatus provided with the fixing device 26 having a structure different from that in Experimental example 1 was used. Incidentally, the description of structures and processes common to those in Experimental example 1 is omitted.

Figure 8:
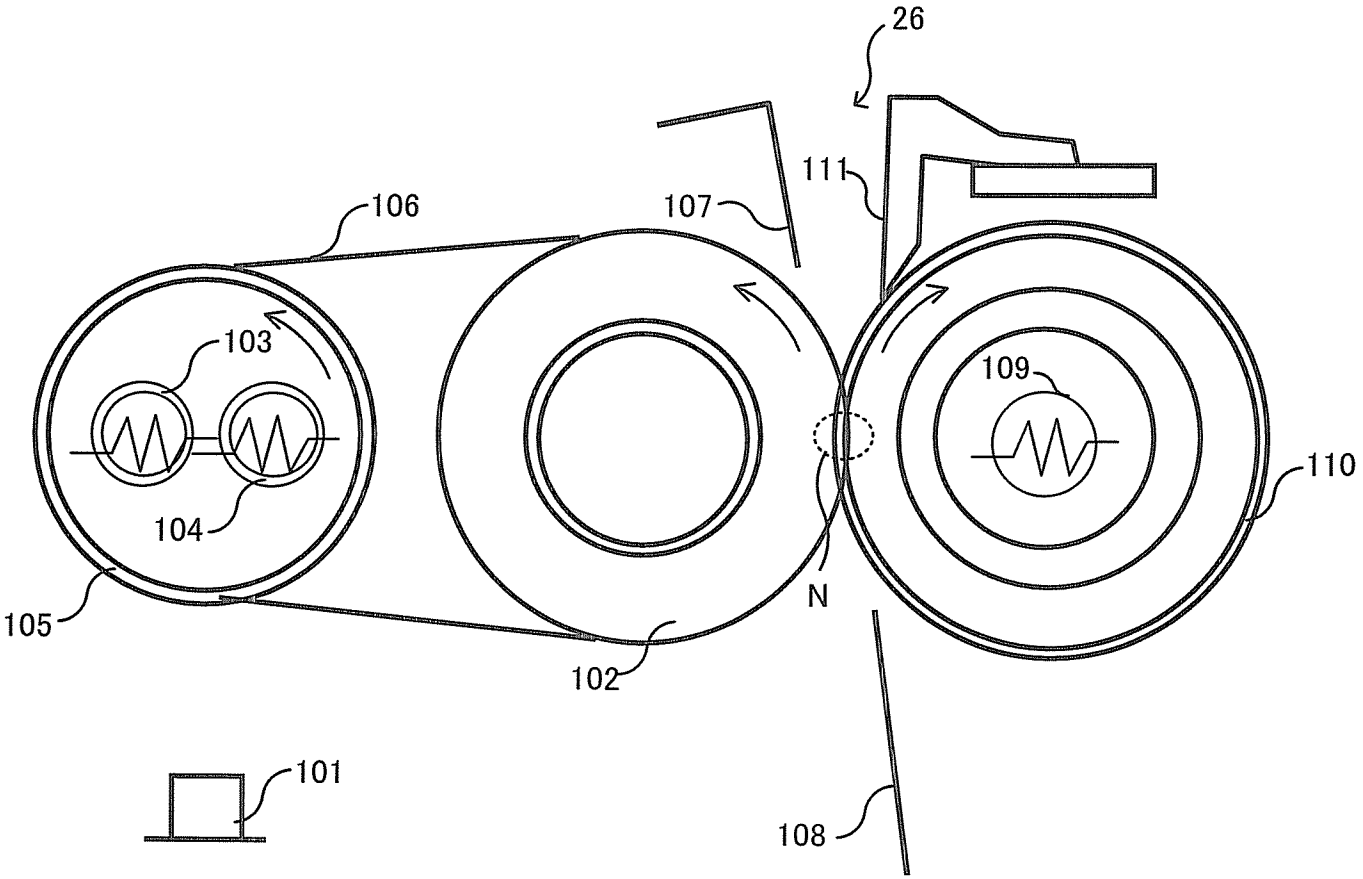
FIG. 8 is a view schematically showing a fixing device of an image forming apparatus according to an embodiment.

As shown in FIG. 8, the fixing device 26 related to Experimental example 2 is configured such that an endless fixing belt 106 which is a rotating body belt is hung around a heating roller 105 having lamps 103 and 104 installed therein and a sponge roller 102 and rotates, and is provided with a pressing roller 110 in press-contact with a region of the fixing belt 106 where the belt is hung around the sponge roller 102. In this manner, a nip portion N is formed by the fixing belt 106 and the pressing roller 110. In the case of the fixing device related to Experimental example 2, the nip width of the nip portion N was 8.75 mm (incidentally, the width at both ends was 9.2 mm).

Recording paper having a toner image formed thereon is inserted between the fixing belt 106 and the pressing roller 110 of the fixing device 26, whereby the toner image is fixed by heating and pressing. After the toner image formed using the capsule-type decolorizable toner is fixed by the fixing device 26, the recording paper P is discharged in a predetermined direction by a paper discharging roller (not shown).

In this image forming apparatus, the passing time was changed as shown in FIG. 9 by setting the conveying speed in the fixing device to 100, 75, or 30 mm/sec. Further, the melting threshold temperature (melting threshold belt temperature) and the density maintaining threshold temperature (density maintaining threshold belt temperature) corresponding to each passing time are also shown in FIG. 9.

Experimental Example 3

In Experimental example 3, an image forming apparatus provided with the fixing device 26 having a structure different from that in Experimental examples 1 and 2 was used. Incidentally, the description of structures and processes common to those in Experimental examples 1 and 2 is omitted.

Figure 10:
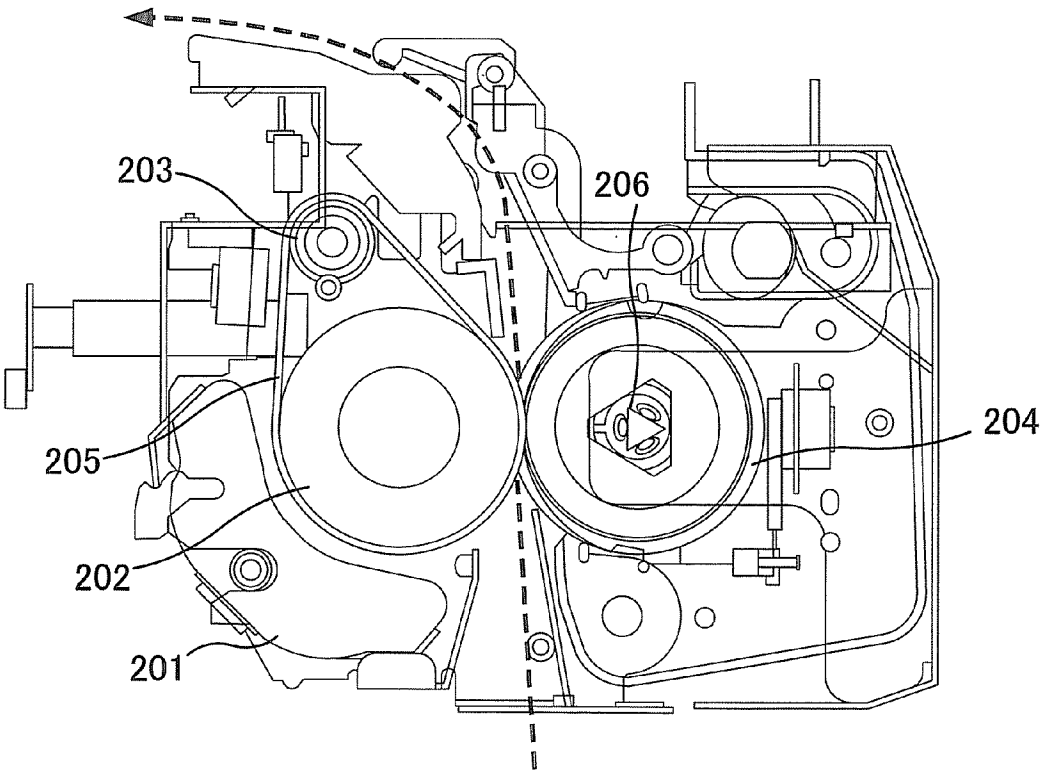
FIG. 10 is a view schematically showing a fixing device of an image forming apparatus according to an embodiment.

As shown in FIG. 10, the fixing device 26 related to Experimental example 3 is configured such that an endless fixing belt 205 which is a rotating body belt is hung around a satellite roller 203 and a minicell roller 202 and rotates, and is provided with a pressing roller 204 in press-contact with a region of the fixing belt 205 where the belt is hung around the minicell roller 202. In this manner, a nip portion N is formed by the fixing belt 205 and the pressing roller 204. The heating of the fixing belt 205 is controlled by an IH coil 201 such that the fixing belt 205 is heated through electromagnetic induction to a predetermined temperature. The pressing roller 204 is also controlled such that the pressing roller 204 is heated by a pressing roller lamp 206 installed therein to a predetermined temperature. In the case of Experimental example 3, the nip width at the nip portion N was 14.5 mm (incidentally, the width at both ends was 15.5 mm).

The paper P having a toner image formed thereon is inserted between the fixing belt 205 and the pressing roller 204 of the fixing device 26, whereby the toner image is fixed by heating and pressing. After the toner image formed using the capsule-type decolorizable toner is fixed by the fixing device 26, the paper P is discharged in a predetermined direction by a paper discharging roller (not shown).

In this image forming apparatus, the passing time was changed as shown in FIG. 11 by setting the conveying speed in the fixing device to 100 or 75 mm/sec. Further, the melting threshold temperature (melting threshold belt temperature) and the density maintaining threshold temperature (density maintaining threshold belt temperature) corresponding to each passing time are also shown in FIG. 11.

Figure 12:
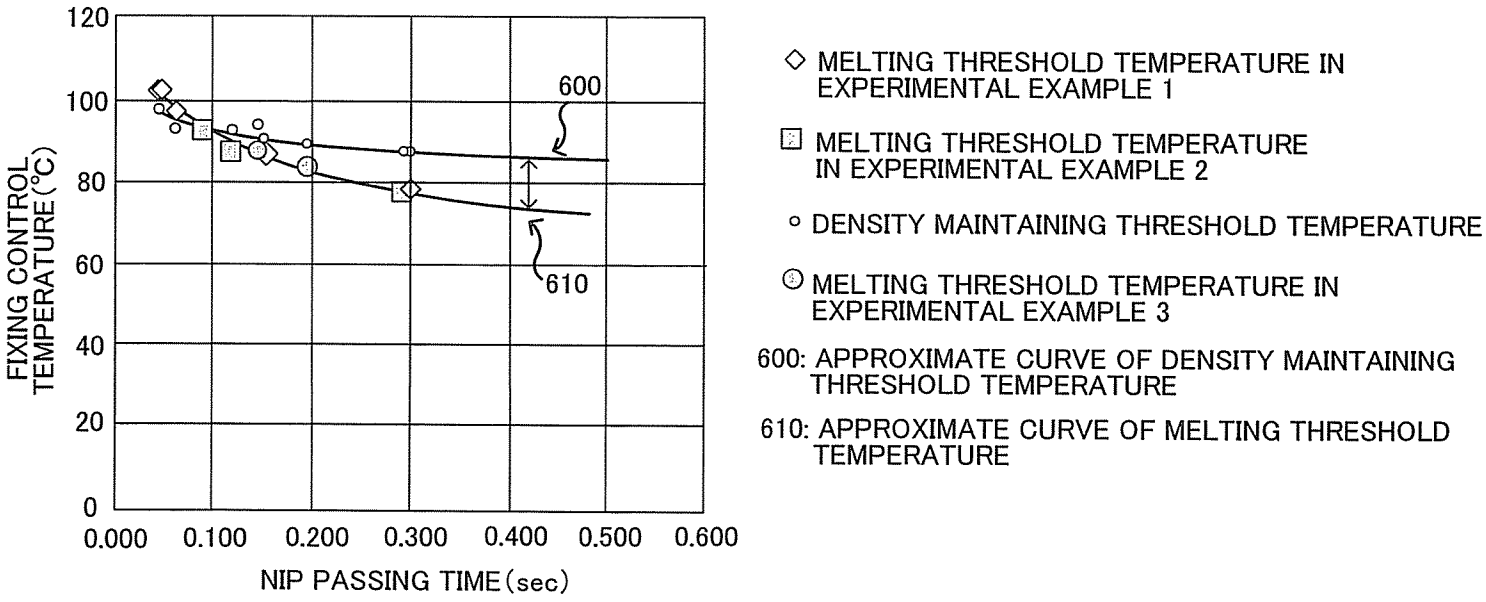
FIG. 12 is a graph showing a relationship between a passing time in an image forming apparatus and a density maintaining threshold temperature or a melting threshold temperature.

Based on Experimental examples 1 to 3, a relationship between the passing time in the nip portion N and the melting threshold temperature (° C.) of the toner or the density maintaining threshold temperature (° C.) of the toner is shown in FIG. 12.

As can be seen from FIG. 12, it is found that the melting threshold temperature depends on the nip width and the paper conveying speed, in other words, the melting threshold temperature changes depending on the nip passing time. It is also found that by setting the nip passing time to 100 msec or more, the fixation can be achieved while maintaining the capsule-type decolorizable toner in a color developed state. Here, by setting the nip passing time to 200 msec or more, a difference between the density maintaining threshold temperature and the melting threshold temperature can be further increased, and therefore, a favorable image can be more reliably obtained. Accordingly, the nip passing time is preferably 200 msec or more (the detail will be described below). On the other hand, if the nip passing time is less than 100 msec, an image cannot be fixed or an image density cannot be maintained.

Further, the composition of the toner is changed as described below, and a relationship between the nip passing time and the melting threshold temperature or the density maintaining threshold temperature was examined in the same manner as above.

Components including 2 parts by mass of 3-(4-diethylamino-2-hexyloxyphenyl)-3-(1-ethyl-2-methylindol-3-yl)-4-azaphthalide as a leuco dye, 4 parts by mass of 1,1-bis(4'-hydroxyphenyl)hexafluoropropane and 4 parts by mass of 1,1-bis(4'-hydroxyphenyl)-n-decane as color developing agents, and 50 parts by mass of 4-benzyloxyphenylethyl caprylate as a decolorizing agent were uniformly dissolved by heating. Then, 30 parts by mass of an aromatic polyvalent isocyanate prepolymer and 40 parts by mass of ethyl acetate were mixed therein as encapsulating agents. The resulting solution was poured into 300 parts by mass of an aqueous solution of 8% polyvinyl alcohol, and the resulting mixture was emulsified and dispersed. After stirring was continued at 90° C. for about 1 hour, 2.5 parts by mass of a water-soluble aliphatic modified amine was added thereto as a reaction agent, and stirring was further continued for about 5 hours, whereby colorless encapsulated particles were obtained. Further, the resulting encapsulated particle dispersion was placed in a freezer (at −30° C.) to develop a color, whereby a dispersion of blue colored particles C2 was obtained. The volume average particle diameter of these colored particles C2 was measured using SALD-7000 manufactured by Shimadzu Corporation and found to be 3.3 μm.

A toner was produced in the same manner as in Experimental example 1 except that as the binder resin, a polyester resin having a Tg of 45° C. and a softening point of 73° C. was used. The thus obtained toner has a complete decolorization temperature Th of 75° C. and a complete color development temperature Tc of −15° C.

For the thus obtained toner, a relationship between the nip passing time and the melting threshold temperature or the density maintaining threshold temperature was examined. As a result, a similar tendency to that in FIG. 12 was exhibited, and by setting the nip passing time to 100 msec or more, fixation could be achieved while maintaining a color developed state. By setting the nip passing time to 200 msec or more, a difference between the melting threshold temperature and the density maintaining threshold temperature was 5° C. or more.

When this toner was fixed by the fixing device used in Experimental example 1 which was set to a temperature of 70° C. (conveying speed: 15 mm/sec), fixation could be achieved in a state where a sufficient density was maintained.

The reason why fixation can also be achieved while maintaining the capsule-type decolorizable toner in a color developed state by setting the nip passing time to 100 msec or more is considered to be because the unevenness of the temperature distribution in the vertical direction of the toner layer on paper is reduced as the nip passing time is longer.

When the fixing control temperature is 90° C., if the nip passing time is short (for example, if the nip passing time is less than 100 msec), the temperature of a portion of the toner layer on the side of the fixing roller or the fixing belt surface exceeds 85° C. which is the decolorization initiation temperature of the coloring agent and decolorization is initiated. Meanwhile, the temperature of a portion of the lower layer of the toner layer on the side of the paper surface is low and the toner is not melted, and therefore, a problem arises that fixation failure occurs.

On the other hand, if the nip passing time is long, for example, if the nip passing time is 292 msec, when the fixing control temperature is, for example, from 80° C. to 85° C., the temperature of a portion of the toner layer on the side of the fixing roller or the fixing belt surface is not higher than 85° C. which is the decolorization initiation temperature of the coloring agent, and therefore, decolorization is not initiated. That is, the temperature of a portion of the lower layer of the toner layer on the side of the paper surface is high and the toner is melted, and therefore, fixation failure does not occur and also the color developed state can be maintained.

Content of Coloring Agent in Toner

Subsequently, the content ratio of the coloring agent in the toner according to this embodiment will be described. In the capsule-type decolorizable toner according to this embodiment, the content of the coloring agent is preferably 10% by mass or more and 30% by mass or less. In the above Experimental examples 1 to 3, the experiments were performed by setting the content of the coloring agent to 10% by mass. The image density in Experimental example 1 (nip passing time: 300 msec) was 0.3. Further, an image was formed in the same manner as in Experimental example 1 except that the content of the coloring agent was changed to 30% by mass. The image density at this time was 0.5.

On the other hand, an image was formed in the same manner as in Experimental example 1 except that the content of the coloring agent was changed to 8% by mass. The image density at this time was 0.25, and a faint image was confirmed by visual observation. Further, an image was formed in the same manner as in Experimental example 1 except that the content of the coloring agent was changed to 33% by mass. The image density at this time was 0.55, however, the color of the encapsulating agent was confirmed after a decolorizing treatment was performed.

Set Range of Fixing Control Temperature

In this embodiment, as described above, the temperature control section 400 controls the temperature (fixing control temperature) of the heating member to a temperature not higher than the density maintaining threshold temperature of the coloring agent and not lower than the melting threshold temperature of the toner.

Figure 13:
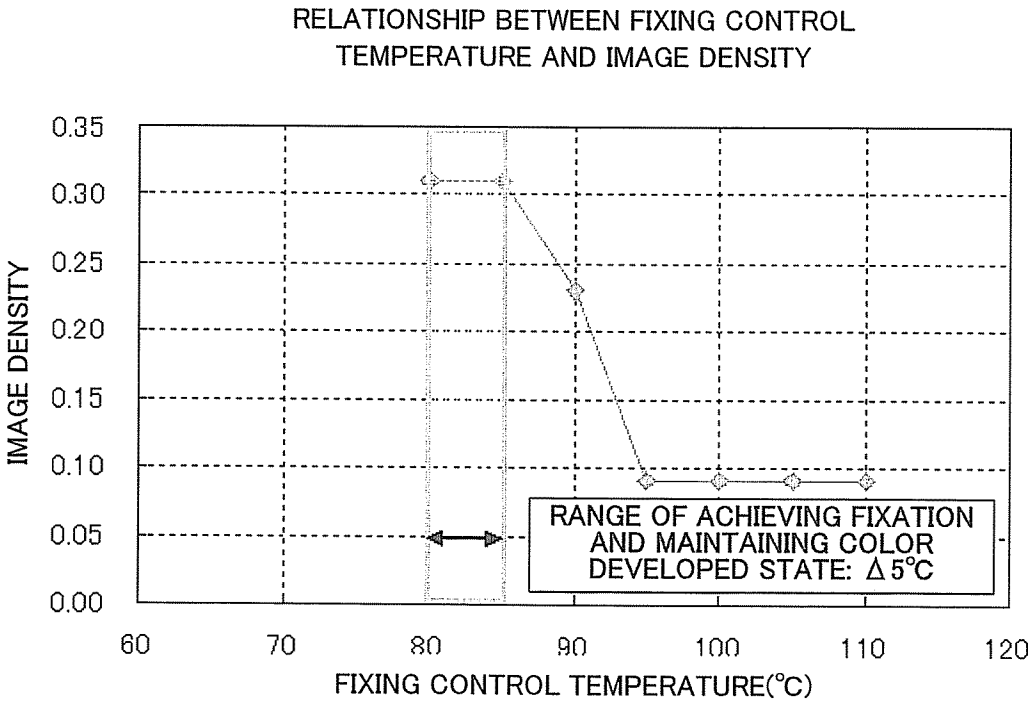
FIG. 13 is a graph showing a relationship between a fixing control temperature and an image density.

In order to further facilitate the understanding of a relationship between the fixing control temperature and the density maintaining threshold temperature, the melting threshold temperature, or the decolorization temperature, one exemplary relationship is shown in FIG. 13.

Incidentally, the decolorization temperature as used herein refers to a threshold (lowest) fixing control temperature, which is higher than the density maintaining threshold temperature and at which the image density is no longer decreased and the image density obtained by measurement becomes constant. When the temperature is set to a temperature not lower than the decolorization temperature as the fixing control temperature, the image density to be measured becomes the lowest.

FIG. 13 is a graph showing a relationship between the fixing control temperature and the image density when the nip passing time was set to 292 msec in Experimental example 2.

From FIG. 13, it is found that fixation can be achieved without causing removal of the toner while maintaining the capsule-type decolorizable toner in a color developed state at 80° C. and 85° C. At this time, the surface temperature of the toner layer is 85° C. or lower. If the fixing control temperature exceeds 85° C., a portion having a temperature exceeding 85° C. which is the density maintaining threshold temperature of the coloring agent starts to emerge from the upper layer of the toner layer, and therefore, the image density starts to decrease. Further, it is found that when the fixing control temperature is set to 95° C., even the temperature of the lowermost layer of the toner layer exceeds 88° C. which is the decolorization temperature of the coloring agent and the color is completely erased.

On the other hand, when the fixing control temperature was set to 75° C., the toner was not sufficiently melted and fixation failure occurred.

There is a physical limitation in making the decolorization initiation temperature of the toner high.

Therefore, in the case of a decolorizable toner, the fixing control temperature is controlled to be preferably 100° C. or lower, more preferably 90° C. or lower. In this case, it is preferred to set the conveying speed such that in order to maintain the color developing property and also to prevent the occurrence of a low-temperature offset, even if the temperature of the fixing belt or the fixing roller is changed, the conveying speed can permit the change. That is, it is preferred to set the conveying speed such that the conveying speed gives a temperature difference between the density maintaining threshold temperature and the melting threshold temperature which can permit the change.

In this embodiment, by setting the conveying speed to 200 msec or more, which is a more preferred configuration, a difference between the density maintaining threshold temperature and the melting threshold temperature can be made larger (in the Experimental example described in this specification, the difference is 5° C. or more). As a result, even if the temperature of the fixing belt or the fixing roller is changed, an image in which the image density is maintained and image defects are not caused can be more reliably formed.

Wile certain embodiments have been described, these embodiments have been presented by way of example only, and are not intended to limit the scope of invention. Indeed, the novel apparatus and methods described herein may be embodied in a variety of other forms; furthermore, various omissions, substitutions and changes in the form of the apparatus described herein may be made without departing from the spirit of the inventions. The accompanying claims and their equivalents are intended to cover such forms or modifications as would fall within the scope and spirit of the inventions.

As described in detail above, according to the technique described herein, a toner image can be fixed to a recording medium while preventing the erasure of the image in a fixing treatment.

What is claimed is:

1. An image forming apparatus, comprising:

a heating member which heats a toner image formed on a recording medium using a decolorizable toner comprising a binder resin and a coloring agent which contains a color developable compound and a color developing agent and a temperature control agent and which has a capsule structure covered with an outer shell, and produced by reacting the binder resin and the coloring agent in a dispersion medium under being heated;

a pressing member which is in press contact with the heating member to form a nip portion and nips and conveys the recording medium in cooperation with the heating member;

a temperature control section which controls the temperature of the heating member to a temperature not higher than the density maintaining threshold temperature of the toner and not lower than the melting threshold temperature of the toner; and a conveyance control section which controls the conveying speed of the recording medium in the nip portion such that a time required for a point on the recording medium to pass through the nip portion is 100 msec or more.

2. The image forming apparatus according to claim 1, wherein the length of the nip portion in the conveying direction of the recording medium in the vicinity of the center of the nip portion in the direction orthogonal to the conveying direction is 4.5 mm or more and 14.5 mm or less.

3. The image forming apparatus according to claim 1, wherein the decolorizable toner contains the coloring agent in an amount of 10% by mass or more and 30% by mass or less.

4. The image forming apparatus according to claim 1, wherein the conveyance control section controls the conveying speed of the recording medium in the nip portion such that the time required for the point on the recording medium to pass through the nip portion is 200 msec or more.

5. The image forming apparatus according to claim 4, wherein the conveyance control section controls the conveying speed of the recording medium in the nip portion such that the time required for the point on the recording medium to pass through the nip portion is 200 msec or more and 300 msec or less.

6. The image forming apparatus according to claim 1, wherein the temperature control section controls the temperature of the heating member to be 1000 e or lower.

7. The image forming apparatus according to claim 1, wherein the temperature control section controls the temperature of the heating member to be 90° C. or lower.

8. The image forming apparatus according to claim 1, wherein the decolorizable toner is produced by aggregating and fusing the coloring agent and particles of the binder resin.

* * * * *